US010597918B2

(12) United States Patent
Kauppila

(10) Patent No.: US 10,597,918 B2
(45) Date of Patent: Mar. 24, 2020

(54) THROWABLE MICROPHONE WITH MAGNETIC LOCK

(71) Applicant: Trick Technologies Oy, Espoo (FI)

(72) Inventor: Timo Pekka Kauppila, Espoo (FI)

(73) Assignee: TRICK TECHNOLOGIES OY, Espoo (FI)

( * ) Notice: Subject to any disclaimer, the term of this patent is extended or adjusted under 35 U.S.C. 154(b) by 0 days.

(21) Appl. No.: 14/819,977

(22) Filed: Aug. 6, 2015

(65) Prior Publication Data

US 2016/0040461 A1 Feb. 11, 2016

Related U.S. Application Data

(60) Provisional application No. 62/034,371, filed on Aug. 7, 2014.

(51) Int. Cl.

| | |
|---|---|
| ***E05C 19/16*** | (2006.01) |
| ***E05B 47/00*** | (2006.01) |
| ***E05B 15/00*** | (2006.01) |
| ***E05C 17/56*** | (2006.01) |

(52) U.S. Cl.

CPC ..... *E05C 19/16* (2013.01); *E05B 15/0073* (2013.01); *E05B 47/00* (2013.01); *E05C 17/56* (2013.01); *E05C 19/161* (2013.01); *E05C 19/163* (2013.01); *E05C 19/165* (2013.01); *E05C 19/166* (2013.01); *E05C 19/168* (2013.01); *Y10T 292/11* (2015.04)

(58) Field of Classification Search

CPC ..... E05C 19/16; E05C 19/163; E05C 19/161; E05C 17/56; E05C 19/165; E05C 19/166; E05C 19/168; E05B 15/0073; E05B 47/00; Y10T 292/11

USPC ..... 292/251.5

See application file for complete search history.

(56) References Cited

U.S. PATENT DOCUMENTS 2,615,227 A * 10/1952 Hornik ..... A44C 5/2071 24/303

2,975,497 A * 3/1961 Budreck ..... A44B 15/002 24/303

(Continued)

OTHER PUBLICATIONS

Ace Backstage Co., Inc, "SOFTPOD", Aug. 4, 2011, StageSound. Refer to engineering drawing (p. 5). (Year: 2011).*

*Primary Examiner* — Kristina R Fulton

*Assistant Examiner* — Faria F Ahmad

(74) *Attorney, Agent, or Firm* — Anderson Gorecki LLP

(57) ABSTRACT

A magnetic lock is presented. The magnetic lock includes a base having a cylindrical opening disposed therein, and having a first magnetic element disposed in a bottom surface of the cylindrical opening of the base. The lock further includes an insert removably securable within the cylindrical opening of the base, the insert having a second magnetic element disposed along a bottom surface thereof. When the insert is inserted into the cylindrical opening of the base and the first magnetic element of the base is aligned with the second magnetic element of the insert the insert is locked within the cylindrical opening of the base. When the insert is rotated within the cylindrical opening of the base to a position wherein the first magnetic element and the second magnetic element are not aligned with each other the insert is removable from the cylindrical opening of the base.

5 Claims, 7 Drawing Sheets

(56) References Cited

U.S. PATENT DOCUMENTS 3,177,546 A * 4/1965 Bey ..... A44B 15/002 24/303
4,425,771 A * 1/1984 Beach ..... E05B 47/0038 292/251.5
4,995,655 A * 2/1991 Freeman ..... E05C 17/56 292/251.5
5,008,984 A * 4/1991 Levy ..... A44C 5/2042 24/303
5,142,746 A * 9/1992 Morita ..... A41F 1/002 24/303
5,152,035 A * 10/1992 Morita ..... A41F 1/002 24/303
5,349,725 A * 9/1994 Levy ..... A44C 5/2009 24/303
5,367,891 A * 11/1994 Furuyama ..... A44C 5/2057 24/303
5,377,392 A * 1/1995 Morita ..... A41F 1/002 24/303
5,444,790 A * 8/1995 Kogen ..... H04R 1/086 381/189
5,572,887 A * 11/1996 Geswelli ..... A44C 5/2071 24/303
5,664,298 A * 9/1997 Nessar-Ivanovic ..... A44C 5/2071 24/303
5,806,346 A * 9/1998 Schlinger ..... A44C 5/2071 24/303
5,868,445 A * 2/1999 Kaufman ..... A45C 13/1069 292/251.5
5,937,487 A * 8/1999 Bauer ..... A41F 1/002 24/303
6,084,498 A * 7/2000 Stelter ..... E05B 73/0017 335/306
6,182,336 B1 * 2/2001 Bauer ..... A41F 1/002 24/303
6,981,391 B2 * 1/2006 Suzuki ..... A44C 5/2076 24/303
7,013,674 B2 * 3/2006 Kretchmer ..... A44C 5/0092 446/137
7,152,282 B2 * 12/2006 Costa ..... A44C 5/20 24/303
7,207,091 B2 * 4/2007 Dunaye ..... A44C 5/2071 24/303
7,367,596 B2 * 5/2008 Leung ..... E05B 65/0021 292/148
7,523,527 B2 * 4/2009 Garber ..... A44C 5/2061 24/303
8,405,479 B1 * 3/2013 Cleveland ..... H01F 7/0273 335/296
8,434,201 B2 * 5/2013 Wang ..... A44C 5/2076 24/303
8,704,626 B2 * 4/2014 Fullerton ..... H01F 7/0247 335/285
8,800,117 B2 * 8/2014 Fiedler ..... A44B 11/258 24/303
8,989,420 B1 3/2015 Hamer
9,307,797 B2 * 4/2016 Sanchez Giraldez ... A41F 1/002
9,414,652 B2 * 8/2016 Fuhrman ..... A44C 5/2071
2005/0023841 A1 * 2/2005 Chen ..... E05C 19/16 292/251.5
2007/0007775 A1 * 1/2007 Gallas ..... E05C 19/16 292/251.5
2007/0134061 A1 * 6/2007 Nance ..... E05B 47/0038 403/362
2009/0250948 A1 * 10/2009 Forrest ..... E05B 1/0015 292/251.5
2009/0273194 A1 * 11/2009 Patterson ..... E05C 19/16 292/251.5
2010/0283269 A1 * 11/2010 Fiedler ..... A44B 11/258 292/251.5
2012/0131967 A1 * 5/2012 Sanchez Giraldez ... A41F 1/002 70/276

* cited by examiner

THROWABLE MICROPHONE WITH MAGNETIC LOCK

CROSS REFERENCE TO RELATED APPLICATIONS

The present application claims the benefit of U.S. Provisional Patent Application No. 62/034,371, filed on Aug. 7, 2014, which is incorporated herein by reference in its entirety.

BACKGROUND

Magnets have a number of applications in industrial and commercial goods. One such application is as a method of joining, locking, or aligning two components together. This is achieved by utilizing the attributes of magnetic fields produced by magnets. These magnetic fields cause magnets with opposing polarities facing each other to attract each other, while the same polarities facing each other repel. Such magnetic fields, regardless of polarity, also attract metallic objects. By utilizing the attractive nature of magnets, locking mechanisms can be built, either by using two magnets, or a magnet and a ferromagnetic material.

One example of such an application would be the magnetic lock on a power cord to a laptop computer, or the small magnets used to close and lock in place the cover for a notebook or tablet computer. In such an application small permanent magnets are used, usually small neodymium magnets, which while exerting a strong magnetic field in comparison to their small size, can be pulled away from each other with relative ease in a perpendicular motion by the user, and hence do not require any external tools or large strain to open.

For applications where a stronger lock or magnetic attractive force is required, usually an electromagnet is used. This is because permanent magnets would be too difficult to pull away from each other using human mechanical strength alone. Electromagnets in this case are much more practical, since a simple power button can release the locking mechanism by deactivating the magnetic field and hence attractive forces.

SUMMARY

Conventional magnetic locks for electronic devices, such as those explained above, suffer from a number of deficiencies. One such deficiency is that conventional magnetic locks using small permanent magnets do not provide a strong lock or magnetic force due to their small size. A deficiency with conventional electromagnetic locks is that they require a power source and are usually heavier and more complicated to implement than permanent magnets and hence can be more expensive and impractical.

Embodiments of the invention significantly overcome such deficiencies by providing a locking mechanism using strong permanent magnets, often composed of rare earth metals, which can still be unlocked or detached using the conventional strength of a user. This magnetic lock can be used in applications where a low weight is desired, or where there is no available power source to power an electromagnet.

In one particular embodiment the locking mechanism is composed of two parts. A first part includes an internal cylindrical cavity with a first magnetic element (a permanent magnet or a piece of material that is attractable to a magnet) attached to the bottom. The second part includes a matching cylinder that fits into the cylindrical cavity with a second magnetic element attached to its bottom. At least one of the magnetic elements comprises a magnet. The magnetic elements are positioned in such a way that they have a strong attractive force when the cylinder is in one type of orientation within the cavity. This attraction is caused by the full alignment of the magnetic elements with each other. When a twisting motion is applied to the cylinder, the magnetic elements become misaligned. While still being in contact with each other, the lower surface area causes a much smaller attractive force, allowing the user to pull the two magnetic elements apart by pulling the cylinder from the cavity.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1A:
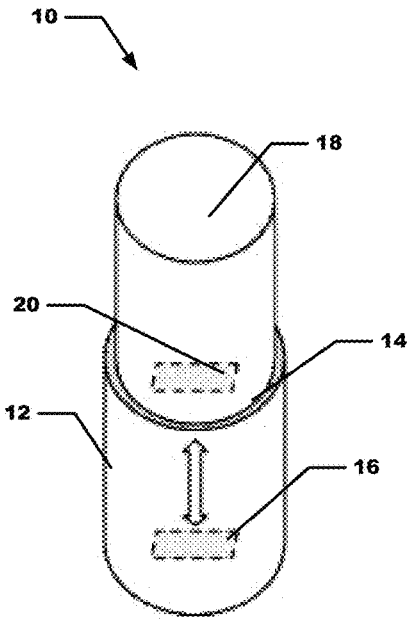
FIG. 1A depicts an isometric view of a magnetic lock in accordance with a particular embodiment of the present invention.

The embodiments set forth below represent the necessary information to enable those skilled in the art to practice the invention and illustrate the best mode of practicing embodiments of the invention. Upon reading the following description in light of the accompanying figures, those skilled in the art will understand the concepts of the invention and recognize applications of these concepts not particularly addressed herein. It should be understood that these concepts and applications fall within the scope of the disclosure and the accompanying claims.

The preferred embodiment of the invention will now be described with reference to the accompanying drawings. The invention may, however, be embodied in many different forms and should not be construed as limited to the embodiment set forth herein; rather, this embodiment is provided so that this disclosure will be thorough and complete, and will fully convey the scope of the invention to those skilled in the art. The terminology used in the detailed description of the particular embodiment illustrated in the accompanying drawings is not intended to be limiting of the invention. In the drawings, like numbers refer to like elements.

In building such a magnetic lock, there are aspects that one needs to take into account. One aspect is the dimensions of the bar magnets. The bar magnets should be rectangular in shape and have a width to length ratio that is preferably between 2:1 and 5:1. Smaller ratios, such as that of squares 1:1, would not create the desired effect of lowering the magnetic forces upon a rotational movement along the center axis. Higher ratios, in turn, would still create the desired effect, however, since rare earth magnets are brittle, such "thin" magnets would be easier to break during assembly and transport A second aspect for consideration is the orientation of the magnetic fields. When two bar magnets are used, the two magnets can have one of two field orientations. In one case, both bar magnets can have their north and south poles located on the flat surface of the magnet. In these cases, the magnets are placed in the cylinder in such a manner that the bottom magnet attached to the cylindrical cavity has the same magnetic orientation as the magnet placed at the bottom of the cylinder. This, in turn, ensures that the magnets attract each other. In such an orientation, there are two possible situations where the two magnets are fully aligned, both 180 degree rotation of the cylinder away from each other. Another version has the magnetic poles situated at the ends of each bar magnet. In this case, there is only one possible full alignment between the two bar magnets. This is useful if the position of the cylinder is desired to face a certain position when locked (magnets are aligned).

A third aspect to be considered is the placement of the magnetic elements within the cylinder. The two magnetic elements have to be located on the central axis of the cylinder, with the center of the magnetic elements aligned with this central axis. Without alignment, the magnetic forces would not align properly causing a weaker locking mechanism. This would also not allow for the misalignment property to function as intended.

Still another aspect for consideration is the fact that the magnetic elements cannot come into direct contact with each other if composed of rare earth metals. This arrangement requires a protective layer to be placed on top of the bottom, top or both magnetic elements to avoid the magnetic elements being damaged when the locking motion is being carried out. Such a protective layer can be achieved by a polycarbonate sticker, overcoming the brittle nature of rare earth magnets.

The magnetic elements can also be broken down into two or more magnetic elements to create the same desired magnetic field and hence the same locking outcome. Such an application is advantageous when the middle part of the axis is required for another component or when using individual smaller magnetic elements can save weight or reduce cost. For example, instead of having a bar magnet with one side with south polarity, one could have several coin magnets or other shaped magnets next to each other with a southern polarity facing up, representing a similar magnetic field.

The present invention is described below referencing a cylindrical insert, though it should be appreciated that any shaped insert (square, rectangular, octagonal, etc.) could be used. The lock uses an insert, which is required to direct the motion of the locking mechanism. Without it, the magnets will just misalign but there is no controlled direction for the release of the lock. The insert also provides more rotational torque to the user making it easier to misalign the magnets, even very strong permanent magnets. The cylindrical cavity along with the insert guides the users pulling motion. Further, the description describes the magnetic elements as being permanent magnets, though it should be appreciated that at least one of the magnetic elements must be a magnet, while the other magnetic element can be a magnet or can be a piece of material that is magnetically attractable.

Figure 1B:
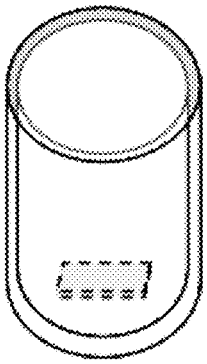
FIG. 1B depicts an isometric view of a magnetic lock in a locked position in accordance with a particular embodiment of the present invention.
Figure 1C:
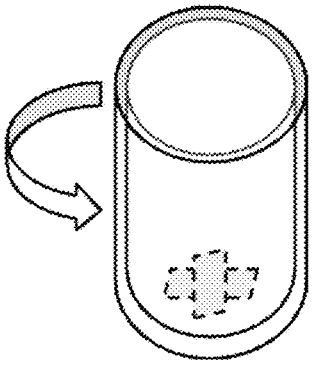
FIG. 1C depicts an isometric view of a magnetic lock in an unlocked position in accordance with a particular embodiment of the present invention.

Referring now to FIGS. 1A-1C, an example of a device 10 incorporating a magnetic lock is shown. Device 10 includes a base 12 having a cylindrical opening 14 within which insert 18 can fit. The cylindrical opening 14 in base 12 has a first magnetic element 16 disposed along a bottom surface of the opening. Insert 18 includes a second magnetic element along a bottom surface thereof. One or both of the magnetic elements is a permanent magnet.

When the insert 18 is inserted into the cylindrical opening 14 of the base 12 and the first magnetic element 16 of the base is aligned with the second magnetic element 20 of the insert 18 the insert 18 is locked within the cylindrical opening 14 of the base 12 and wherein when the insert 18 is rotated within the cylindrical opening 14 of the base to a position wherein the first magnetic element 16 and the second magnetic element 20 are not aligned with each other the insert 18 is removable from the cylindrical opening 14 of the base 12.

Referring now to FIGS. 2A-2F, in a particular embodiment using two magnets as the magnetic elements, as opposed to having one magnet and a piece of material magnetically attractable as the two magnetic elements, the poles 52 and 54 of the magnet 50 are at the tips of the bar magnet. The poles 62 and 64 of the magnet 60 are at the tips of the bar magnet. Having the poles on the tips of the bar magnets provides the added benefit that when you twist such an arrangement, the similar poles of the two magnets start facing each other. This, in turn, causes the attractive forces between the two magnets to diminish while the repelling forces begin to increase, as more of the surface area and magnetic field of the north pole is being in contact with the north pole/magnetic field of the opposing magnet. The resulting orientation pushes the magnets apart, helping the user unlock the system by only twisting. Hence, while a 90 degree rotational movement will misalign the magnetic fields and hence allow the user to pull the magnets apart, a 180 degree twisting motion will not only cause the magnetic fields to misalign, unlocking the locking mechanism, but it will also cause the magnets to push each other apart, making the locking mechanism more successful since the user needs pull less.

Figure 2A:
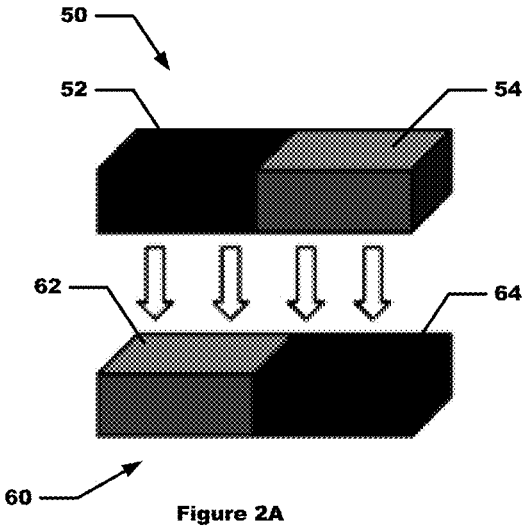
FIG. 2A depicts an isometric view of a pair of magnetics proximate each other in accordance with a particular embodiment of the present invention.
Figure 2B:
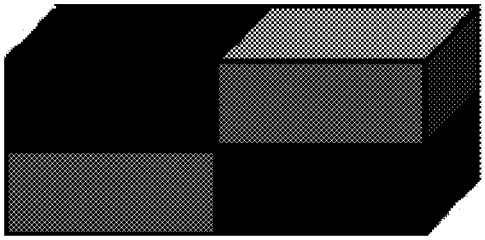
FIG. 2B depicts an isometric view of a pair of magnetics in a locked position in accordance with a particular embodiment of the present invention.
Figure 2C:
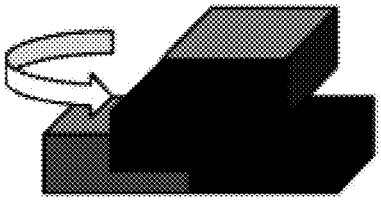
FIG. 2C depicts an isometric view of a pair of magnetics in an unlocked position in accordance with a particular embodiment of the present invention.
Figure 2D:
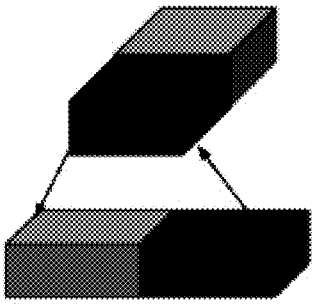
FIG. 2D depicts an isometric view of a pair of magnetics showing the attractive forces in accordance with a particular embodiment of the present invention.
Figure 2E:
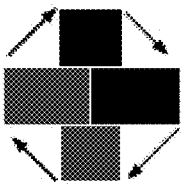
FIG. 2E depicts an isometric view of a pair of magnetics showing the attractive forces in accordance with a particular embodiment of the present invention.
Figure 2F:
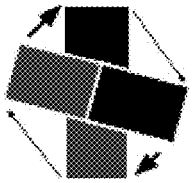
FIG. 2F depicts an isometric view of a pair of magnetics showing the attractive forces and repulsive forces in accordance with a particular embodiment of the present invention.
Figure 3A:
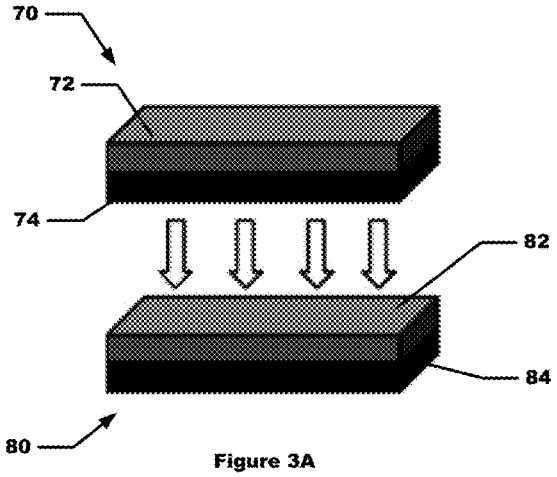
FIG. 3A depicts an isometric view of a pair of magnetics proximate each other in accordance with a particular embodiment of the present invention.
Figure 3B:
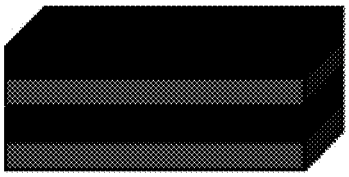
FIG. 3B depicts an isometric view of a pair of magnetics in a locked position in accordance with a particular embodiment of the present invention.
Figure 3C:
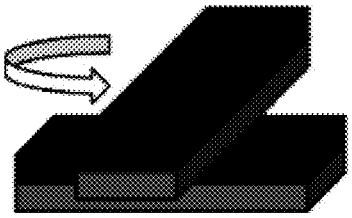
FIG. 3C depicts an isometric view of a pair of magnetics in an unlocked position in accordance with a particular embodiment of the present invention.
Figure 3D:
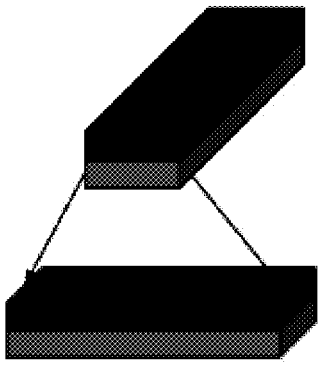
FIG. 3D depicts an isometric view of a pair of magnetics showing the attractive forces in accordance with a particular embodiment of the present invention.
Figure 3E:
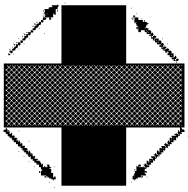
FIG. 3E depicts an isometric view of a pair of magnetics showing the attractive forces in accordance with a particular embodiment of the present invention.
Figure 3F:
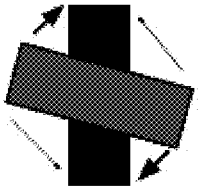
FIG. 3F depicts an isometric view of a pair of magnetics showing the attractive forces and repulsive forces in accordance with a particular embodiment of the present invention.

Another benefit is that when the user puts the insert in the cavity, there is a lower chance that the magnets will not lock with each other, attributed by a misalignment of the magnets. This is because, unlike the other arrangement (magnetic poles on the faces of the magnets), when the two magnets are 90 degrees separated, the north pole of one magnet will push the north pole of the other magnet while the south pole pulls. These forces combine to cause a twisting force for the bar magnet as seen in FIG. 2F. Another added benefit of such an arrangement is that a misalignment can cause noticeable upward pressure due to the repelling forces of the two misaligned magnets, indicating to the user that the magnets did not align and hence did not lock. This is an important haptic indicator for the user because it is impossible for the user to see inside the cylindrical cavity after placing the insert into the cylindrical opening. Hence, without any feedback from the locking mechanism the only way to make sure that the magnets have been correctly aligned is by trying to pull on the magnetic lock and see if it will be released manually.

Referring now to FIGS. 3A-3F, in this particular embodiment the poles 72 and 74 of the magnet 70 are at the faces of the bar magnet. The poles 82 and 84 of the magnet 80 are at the faces of the bar magnet. When poles are at the faces, the ends of the bottom bar magnet will both try to attract the tip of the other bar magnet, trying to get the magnet to twist. These forces will cancel each other out in a 90 degree set up. Once the two magnets 70 and 80 are slightly aligned towards one arrangement, the magnets should theoretically immediately align, since now one attraction force will be greater due to the shorter distance, however, when using the cylinder arrangement, there are usually frictional forces caused by the sides of the cylinder as well as the contact between the magnets that also needs to be overcome, meaning, even though the angle between the two bar magnets in the arrangement would be more than 90 degrees, for example 60 degrees, the magnetic forces pulling/twisting the magnets to align with each other, might not overcome the frictional forces, leaving the magnets to be not entirely aligned, and hence, the locking mechanism would not be as effective due to the minimal magnetic forces at work.

Figure 4A:
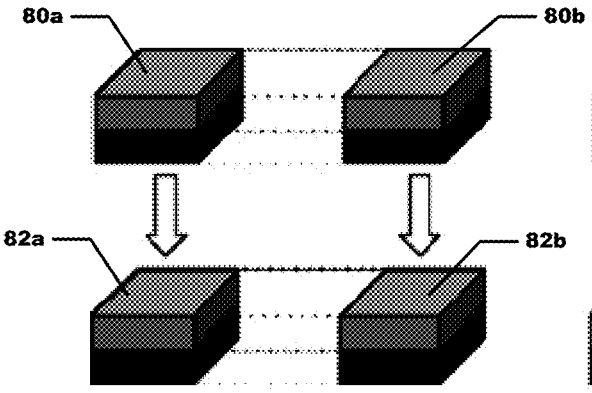
FIG. 4A shows an embodiment using multiple magnets in accordance with a particular embodiment of the present invention.
Figure 4B:
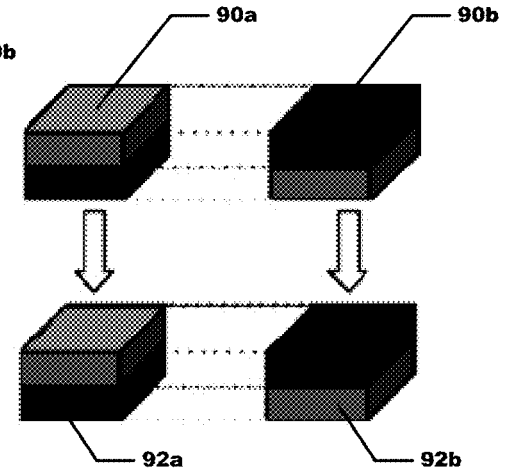
FIG. 4B shows an embodiment using multiple magnets in accordance with a particular embodiment of the present invention.

Referring now to FIGS. 4A-4B, multiple magnets may be used with both the insert and the base. In FIG. 4A, magnets 80A and 80B are disposed having the same polarity. Magnets 82A and 82B are also disposed having the same polarity, further magnet 80A and 82A will be attracted to each other, as will magnets 80B and 82B. In FIG. 4B, magnets 90A and 90B are disposed having the opposite polarity. Magnets 92A and 92B are also disposed having the opposite polarity, further magnet 90A and 92A will be attracted to each other, as will magnets 90B and 92B.

Figure 5:
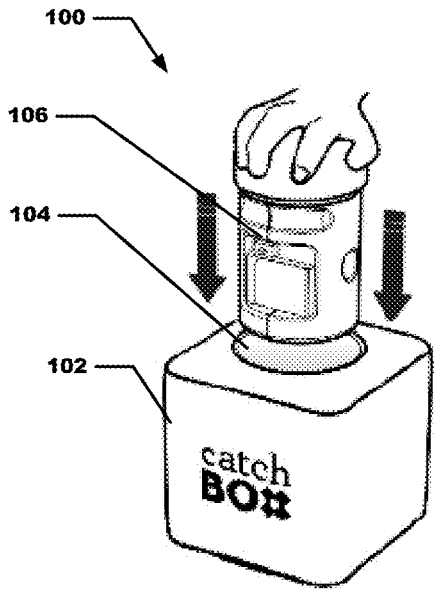
FIG. 5 shows a particular embodiment of the magnetic lock for an electronic device.

Referring now to FIG. 5, in a particular embodiment the magnetic lock described above is used in a device such as a throwable microphone 100. The base 102 is a soft, padded structure. The microphone portion 106 fits within the base opening 104. Magnets (not shown) in the base and the microphone portion 106 are used to lock the microphone portion 106 within the base 102. As such, the device 100 can be handled (including being thrown) with the microphone portion 106 magnetically locked with the base 102. If the microphone portion 106 needs to be removed from the base 102, the microphone portion 106 is rotated and easily removed.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

What is claimed is:

1. An apparatus comprising:

a padded base having a cylindrical opening formed therein, and comprising a first magnetic element disposed proximate to a bottom surface of said cylindrical opening of said base; and an insert comprising a microphone and a second magnetic element disposed proximate to a distal end of the insert, such that when the distal end of the insert is inserted into said cylindrical opening of said base and said first magnetic element of said base is aligned with the second magnetic element of said insert in a first orientation, said insert is held within said cylindrical opening of said base by attractive force between the first magnetic element and the second magnetic element, and wherein when said insert is rotated within said cylindrical opening of said base to a second orientation wherein said first magnetic element and said second magnetic element are not aligned with each other, the attractive force between the first magnetic element and the second magnetic element is diminished and said insert is not held within said cylindrical opening of said base by attractive force between the first magnetic element and the second magnetic element;

wherein at least one of said first magnetic element and said second magnetic element comprises a permanent magnet.

2. The apparatus of claim 1 wherein said first magnetic element comprises a first bar magnet and said second magnetic element comprises a second bar magnet, the first bar magnet comprising a rectangular prism with a width-to-length ratio between 2:1 and 5:1, wherein a first face of the first bar magnet defined by width and length dimensions is parallel with a second face of the second bar magnet defined by width and length dimensions.

3. The apparatus of claim 1 wherein a central axis of said first magnetic element is coincident with a central axis of said cylindrical opening of said base.

4. The apparatus of claim 1 further comprising a protective layer disposed between said first magnetic element and said second magnetic element.

5. The apparatus of claim 1 further comprising at least one additional magnetic element disposed in said bottom surface of said cylindrical opening of said base.

* * * * *